US010730163B2

(12) United States Patent
Orlandi et al.

(10) Patent No.: US 10,730,163 B2
(45) Date of Patent: Aug. 4, 2020

(54) ABRASIVE-FLUID JET CUTTING DEVICE

(71) Applicant: C.M.S. S.p.A., Zogno (IT)

(72) Inventors: Davide Orlandi, Carvico (IT); Stefano Benaglia, Curno (IT); Giuseppe Pedrini, Bonate Sopra (IT)

(73) Assignee: C.M.S. S.p.A. (IT)

( * ) Notice: Subject to any disclaimer, the term of this patent is extended or adjusted under 35 U.S.C. 154(b) by 246 days.

(21) Appl. No.: 15/450,376

(22) Filed: Mar. 6, 2017

(65) Prior Publication Data

US 2017/0259400 A1 Sep. 14, 2017

(30) Foreign Application Priority Data

Mar. 8, 2016 (IT) ..... 102016000024119

(51) Int. Cl.
*B24C 7/00* (2006.01)
*B24C 5/02* (2006.01)
*B24C 1/04* (2006.01)

(52) U.S. Cl.
CPC ..... *B24C 7/003* (2013.01); *B24C 1/045* (2013.01); *B24C 5/02* (2013.01); *B24C 7/00* (2013.01); *B24C 7/0076* (2013.01)

(58) Field of Classification Search
CPC ..... B24C 7/003; B24C 7/00; B24C 7/076; B24C 1/045; B24C 5/02
See application file for complete search history.

(56) References Cited

U.S. PATENT DOCUMENTS

| | | | | |
|---|---|---|---|---|
| 4,854,091 | A | 8/1989 | Hashish et al. | |
| 6,200,203 | B1 | 3/2001 | Xu et al. | |
| 7,040,959 | B1 * | 5/2006 | Panuska | B24C 5/02 239/310 |
| 8,425,280 | B2 | 4/2013 | Siepi et al. | |
| 8,540,552 | B2 | 9/2013 | Reukers | |
| 2002/0173220 | A1 | 11/2002 | Lewin et al. | |
| 2010/0173570 | A1 * | 7/2010 | Reukers | B24C 1/045 451/91 |
| 2012/0273277 | A1 | 11/2012 | Blange' et al. | |
| 2014/0087635 | A1 | 3/2014 | Ogawa et al. | |

FOREIGN PATENT DOCUMENTS

EP 2397286 A2 12/2011

* cited by examiner

*Primary Examiner* — Joseph J Hail
*Assistant Examiner* — J Stephen Taylor
(74) *Attorney, Agent, or Firm* — Laubscher & Laubscher, P.C.

(57) ABSTRACT

An abrasive fluid jet cutting device is disclosed comprising a rotating joint that includes a first path for abrasive and a second path for fluid, a mixing chamber where the first and second paths meet, a first expanding volume arranged above the first path to accumulate abrasive, and a second expanding volume arranged below the first path to accumulate abrasive between the first volume and the mixing chamber, in which the second volume forms a barrier against the return flow of humidity along the first path.

16 Claims, 2 Drawing Sheets

ABRASIVE-FLUID JET CUTTING DEVICE

BACKGROUND OF THE INVENTION

The invention relates to a cutting device for making cuts with a jet of a mixture of fluid (in general water) and solid particles (abrasive).

Specifically, but not exclusively, the invention can be usefully used in a numerically controlled machining center, for example with five controlled axes.

Patent publication U.S. Pat. No. 4,854,091 shows an abrasive fluid jet cutting machine with a rotating assembly that defines a mixing chamber in which the abrasive is introduced into a flow of pressurised water.

Patent publication U.S. Pat. No. 8,425,280 shows an abrasive fluid jet cutting machine in which a rotating distributor has a stator and a rotor between which there is a cavity with a tilted bottom to convey the particles of abrasive to an outlet and thus to the mixing chamber.

Patent publication U.S. Pat. No. 8.540,552 shows an abrasive fluid jet cutting machine in which high-pressure water flows along a first passage in a rotating distribution column and the abrasive is introduced in a vacuum in a sealed chamber and is then conveyed through a Venturi effect along a second passage, in the distribution column, outside and parallel to the first passage.

Prior-art abrasive fluid jet cutting devices are improvable in several ways. It is desirable, in particular, to make sure that the path of the solid particles (abrasive) is not affected by a return flow of humidity, for example humidity coming from the fluid (water) path. It is further desirable to ensure easy and regular flowing of the solid panicles of abrasive along the path thereof, still in the context of a structure of relatively compact dimensions.

SUMMARY OF THE INVENTION

One object of the invention is to make a fluid jet cutting device with solid particles (abrasive) that is an improvement on the prior art, with particular reference to at least one of the aspects mentioned above.

One advantage is to provide a fluid jet cutting device that is able to maintain the solid particles (abrasive) dry along at least one part of the path thereof before being mixed with the fluid.

One advantage is to avoid the return flow of humidity along the path of the solid particles (abrasive) and/or to maintain substantially dry the path of the solid particles or at least a considerable part of the path.

One advantage is to avoid or reduce the risk of faults (clogging, blocks, etc) the supply flow of the solid particles (abrasive).

One advantage is to provide a fluid jet cutting device with a rotating assembly (joint or distributor) of relatively reduced dimensions.

One advantage is to ensure easy and regular sliding of the particles to a mixing zone with the pressurised fluid.

One advantage is to make available a constructionally simple and cheap fluid jet cutting device.

Such objects and advantages and still others have all been reached by the cutting device according to one or more of the claims set out below.

In one embodiment, a rotating assembly, which is in particular intended for distributing fluid (pressurised water) and solid particles (abrasive) to a fluid-abrasive jet cutting head, includes a first path for particles and a second path for fluid, which are separated from one another, in which the first path comprises a first (upper) expanding volume, a second (lower) expanding volume and a path portion that joins together the two expanding volumes, such that the second expanding volume hinders the passage (return flow) of humidity through the aforesaid path portion to the first expanding volume.

BRIEF DESCRIPTION OF THE DRAWINGS

The invention can be better understood and implemented with reference to the attached drawings that illustrate one embodiment thereof by way of non-limiting example.

DETAILED DESCRIPTION

Figure 1:
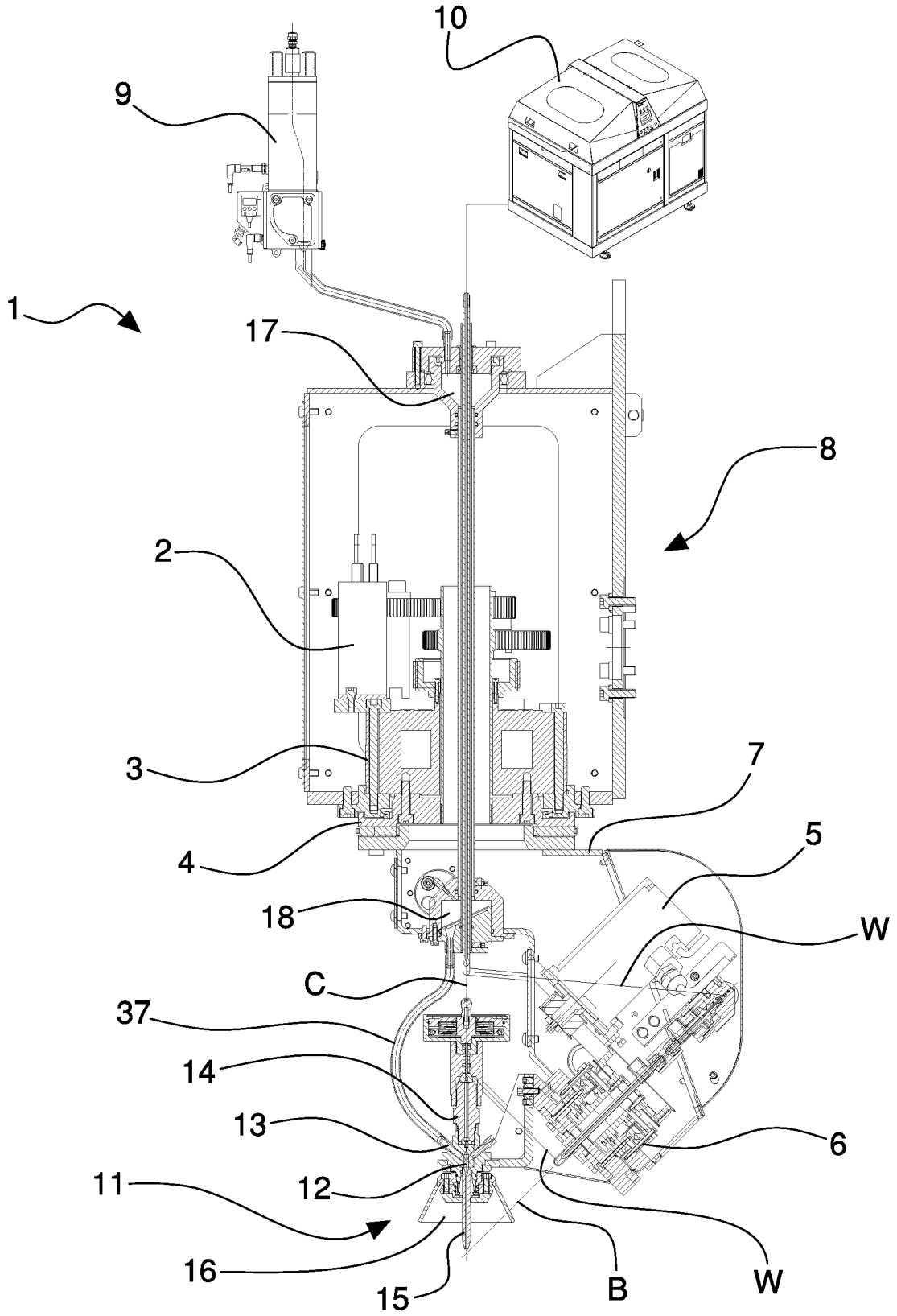
FIG. 1 is a section in a vertical elevation of one example of an abrasive fluid jet cutting device according to the invention.
Figure 2:
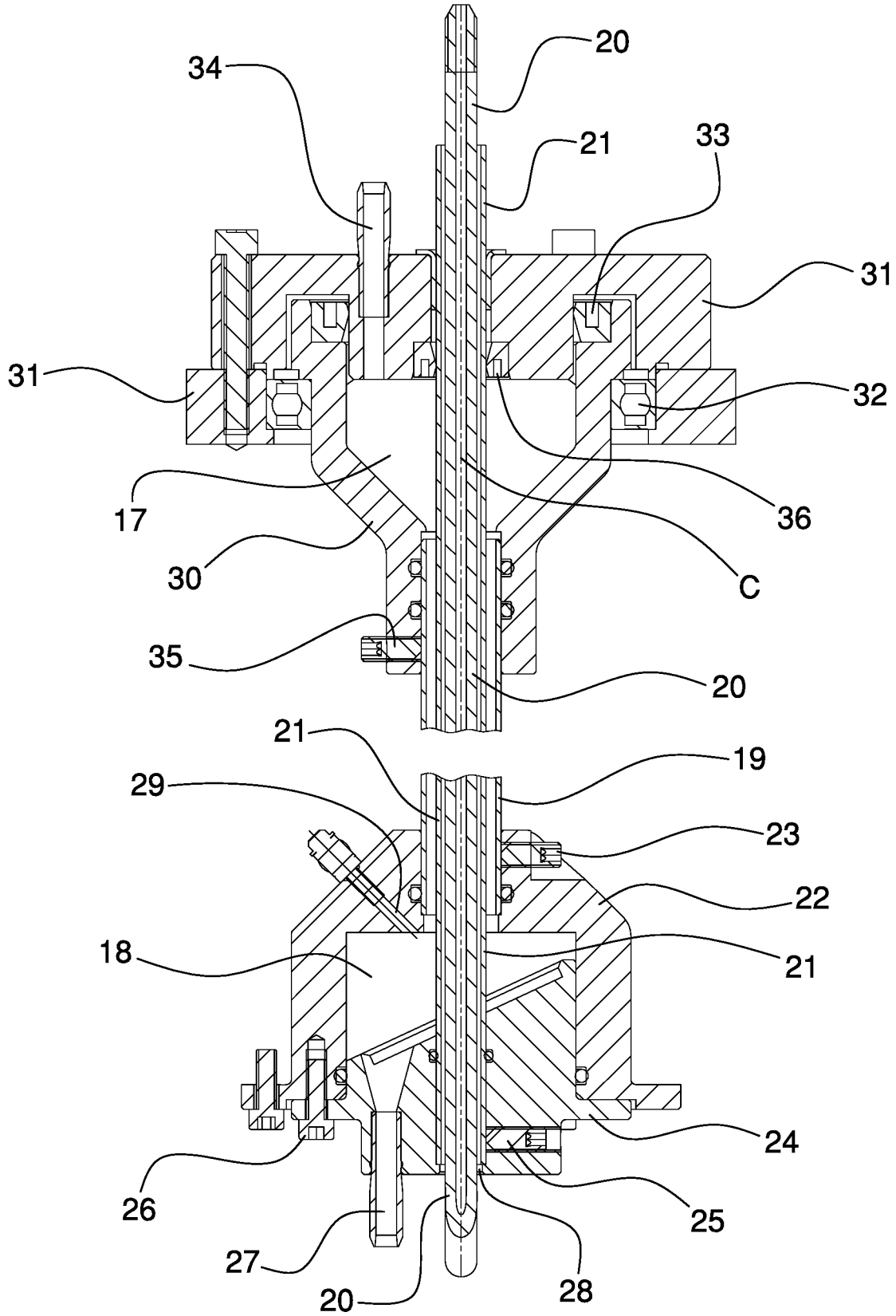
FIG. 2 shows an enlarged and fragmentary detail of FIG. 1.

With reference to the aforesaid figures, with 1 overall a fluid jet cutting device (water) with solid particles (abrasive) has been indicated. In particular, the cutting device 1 can be arranged on a machining center (not shown, for example of known type), for example a machining center with five controlled axes. The cutting device 1 can be, for example, movable on three orthogonal reciprocally linear axes X, Y, Z (not shown). The cutting device 1 can be, further, movable on two rotation axes C and B (as will be explained better below). The cutting device 1 can be used, for example, to cut objects made of stone, marble, granite, glass, metal, and any material that is suitable for machining with abrasive water jet technology.

The cutting device 1 is movable around a C axis (usually called the fourth axis). The C axis comprises a vertical rotation axis.

The cutting device 1 is movable around a B axis (usually known as the fifth axis). The B axis comprises an oblique rotation axis. In this embodiment the B axis coincides with the C axis. The C and B axes form an angle of variable size.

The cutting device 1 comprises a driving device of the C axis that comprises, in particular, a servomotor 2 for controlling the rotation of the C axis and a reduction gear 3 for the C avis. With 4 a (rotating) flange has been indicated for fitting the reduction gear for the C axis.

The cutting device 1 comprises a driving device of the B axis that comprises, in particular, a servomotor 5 controlling the rotation of the B axis and a reduction gear 6 for the B axis. With 7, overall, a (rotating) support body of the B axis has been indicated.

The cutting device 1 comprises a rotating assembly 8 (with the function of rotating joint or rotating distributor of fluid and particles) that includes at least one first path for solid particles (abrasive) and a second path for pressurised fluid (water). The assembly 8 extends along a (vertical) axis and can rotate around the axis thereof. The assembly 8 can rotate around a vertical axis. The assembly 8 can rotate, in particular, around the C axis.

The first path is intended for connecting to a source of solid particles that comprises an abrasive dosing device 9. The second path is intended for connecting to a source of fluid that comprises an intensifier 10 of high-pressure water. In the context of the rotating assembly 8, the first path (solid particles) and the second path (pressurised fluid) are separate from one another.

The cutting device 1 comprises a cutting head 11. The cutting head 11 is connected to the (joint or distributor)

rotating assembly 8 to receive from the latter the solid particles and the pressurised fluid. The cutting head 11 comprises a particles-fluid mixing zone 12 where the first path (abrasive) and the second path (water) can meet. The mixing zone 12 comprises a mixing chamber. The cutting head 11 comprises at least one inlet 13 for particles that communicates with the mixing zone 12. The cutting head 11 comprises at least one inlet 14 for the fluid that communicates with the mixing zone 12. The cutting head 11 comprises at least one outlet 15 for a jet of fluid-particles mixture communicating with the mixing zone 12. The cutting head 11 comprises at least one spray-containing cap 16 arranged near the outlet 15 of the jet coaxially to the jet itself.

The cutting device 1 comprises a first expanding volume 17 arranged along the first path where a first accumulation of solid particles (abrasive) can occur. The cutting device 1 comprises a second expanding volume 18 where a second accumulation of solid particles (abrasive) can occur. Each expanding volume 17 and 18 causes a widening of the passage section of the first path where, consequently, the advancement flow of the particles can be slowed. The second expanding and particles accumulation volume 18 is arranged between the first expanding and particles accumulation volume 17 and the mixing zone 12.

The first expanding volume 17 is arranged above, i.e. at a greater height, than the second expanding volume 18. The first expanding volume 17 communicates with an upper (inlet) end of a vertical portion of the first path (solid particles path). The second expanding volume 18 communicates with a lower (outlet) end of a vertical portion of the first path (solid particles path).

The rotating assembly 8 comprises at least one (rotating) first pipe 19 and at least one (rotating) second pipe 20 inside the first pipe 19. The first pipe 19 and the second pipe 20 are coaxial to one another. The first pipe 19 and/or the second pipe 20 have an axis coinciding with the C axis. The first (outer) pipe 19 is arranged for the passage of the particles. The second (inner) pipe 20 is arranged for the passage of high pressure fluid (water).

The rotating assembly 8 comprises at least one (rotating) third protection pipe 21 interposed between the first pipe 19 and the (rotating) second pipe 20. The third pipe 21 is coaxial to the first pipe 19 and/or to the second pipe 20. The first path (passage of the flow of solid particles of abrasive) is comprised between the (outermost) first pipe 19 and at least one portion of the (innermost) third pipe 21.

The first path is at least partially comprised between the first pipe 19 and the second pipe 20. The first path is at least partially comprised between the first pipe 19 and the third pipe 21. The second path is at least partially comprised inside the second pipe 20.

At least one portion of the (rotating) second pipe 20 passes through the first expanding volume 17. At least one portion of the (rotating) third pipe 21 passes through the first expanding volume 17.

At least one portion of the first path (particles path) comprises a passage section of annular shape that surrounds at least one portion of the second path (fluid path).

The second expanding volume 18 is bounded at least partially by a first or upper rotating portion 22. The first portion 22 is of flanged shape. The first pipe 19 is fixed to the first portion 22. The first pipe 19 comprises a bottom (outlet) end fixed to the first portion 22, for example by at least one security dowel 23. It is possible to arrange a seal (at least one seal ring) between the first pipe 19 and the first portion 22.

The second expanding volume 18 is bounded at least partially by a rotating second or lower portion 24. The second portion 24 is of flanged shape. The third pipe 21 is fixed to the second portion 24. The third pipe 21 comprises a lower end fixed to the second portion 24, for example by at least one security dowel 25. It is possible to arrange a seal (at least one seal ring) between the third pipe 21 and the second portion 24.

The first portion 22 and the second portion 24 are fixed together, for example by a fixing device 26 of screw type.

The second portion 24 delimits a bottom of the second expanding volume 18. The bottom of the second expanding volume 18 is tilted towards an outlet 27 for particles of abrasive. The outlet 27 is arranged on a rotating lower portion. In particular, the outlet 27 is arranged on the second portion 24.

The first portion 22 comprises at least one (central) hole for coupling the first pipe 19 and for the passage of the second pipe 20 and/or of the third pipe 21. The second portion 24 comprises at least one hole for coupling the third pipe 21 and/or for the passage of the second pipe 20.

The second portion 24 comprises, in addition to the outlet 27 for particles, also an outlet 28 for the pressurised fluid or for the second pipe 20 supplying the pressurised fluid. The outlets 27 and 28 are spaced apart from one another. The outlet 28 is arranged more centrally and the outlet 27 is arranged more peripherally.

At least one first portion of the first path (abrasive path) connects together the (upper) first expanding volume 17 and the (lower) second expanding volume 18. The aforesaid first portion of the first connecting path between the volumes 17 and 18 is arranged vertically coinciding with at least one component in a vertical direction.

The aforesaid first connecting portion of the first path is of tubular shape. The aforesaid first connecting portion of the first path comprises one passage section that is narrower by at least half, or at least one third, or at least one fourth or at least one fifth, or at least one sixth, than a passage section of the first expanding volume 17 and/or than a passage section of the second expanding volume 18.

At least one second portion of the first path (abrasive path) connects together the second expanding volume 18 and the mixing zone 12. This second connecting portion of the first path (between the volume 18 and the zone 12) comprises one passage section that is narrower by at least half, or at least one third, or at least one fourth or at least one fifth, or at least one sixth, than a passage section of the first expanding volume 17 and/or than a passage section of the second expanding volume 18.

The first path comprises an inlet 29 for a drying fluid. The inlet 29 for drying fluid flow into the second expanding volume 18. The inlet 29 for drying fluid belongs to the rotating assembly 8.

The first expanding volume 17 is bounded at least partially by a rotating portion 30 and by a static portion 31. The rotating portion 30 and the static portion 31 are rotatably coupled with one another, for example by interposing a rolling support 32. It is possible to arrange a seal 33 to make a (dynamic) seal between the rotating portion 30 and the static portion 31.

An inlet 34 for the solid particles (of abrasive) is arranged on the static portion 31. The rotating portion 30 comprises a bottom with a flared (frusto-conical) shape decreasing downwards, in particular to an (upper) inlet end of the first pipe 19. The bottom of the first expanding volume 17 comprises at least one bottom part of the rotating portion 30.

The rotating portion 30 is of flanged shape. The static portion 31 is of flanged shape. The first pipe 19 is fixed to the rotating portion 30. In particular, the first pipe 19 comprises an upper (inlet) end fixed to the rotating portion 30, for example by at least one security dowel 35. It is possible to arrange a seal (at least one or two seal rings) to make a seal between the first pipe 19 and the rotating portion 30.

The rotating portion 30 comprises at least one (central) hole for coupling the first pipe 19 and/or for the passage of the second pipe 20 and/or of the third pipe 21. The static portion 31 comprises at least one hole for rotatable coupling with the third pipe 21 and/or for the passage of the second pipe 20. The static portion 31 is rotatably coupled with the third pipe 21, for example by interposing a rolling support. It is possible to arrange, in particular, a seal 36 to make a (dynamic) seal between the third pipe 21 and the static portion 31.

The inlet 13 for particles of the cutting head 11 is connected to an outlet for particles arranged on the rotating assembly 8, in which this outlet is arranged downstream (with reference to the flow of particles) of the second expanding volume 18. The particles outlet of the rotating assembly 8 comprises the outlet 27. The inlet 13 and the outlet 27 are connected by a hose 37.

For greater clarity and simplicity, one portion of the second path (fluid path), comprised between the outlet 28 on the rotating assembly 8 as far as the inlet 14 on the cutting head 11, has been shown schematically by a line W.

In use, the solid particles (abrasive) and the pressurised fluid (water) are supplied along the respective paths, in the first path the particles are, substantially, at atmospheric pressure, whereas in the second path the fluid is at a high pressure that is suitable for generating the cutting jet.

The solid particles of abrasive, as said, flow along the first path: enter the first expanding volume 17, drop by gravity to the lower outlet of the first volume 17 and then traverse the annular portion that descends as far as the second expanding volume 18; from here, they pass through the outlet 27 and then reach, through the pipe 37, the mixing zone 12. The abrasive water jet exits through the outlet 15.

The solid particles come into contact with the fluid (water) in the mixing zone 12. It may happen that there is a return flow of humidity flows along the first particles path, until it arrives at the second expanding volume 18, in which the passage section widens considerably, forming a sort of barrier against the further return flow of humidity along the pipe 19. The solid particles that traverse the pipe 19 remain substantially dry, thus like the solid particles contained in the first expanding volume 17. The flow of the particles of abrasive is thus guaranteed.

It is further possible to introduce a drying fluid inside the first path, in particular into the second expanding volume 18, by the inlet 29. This drying fluid could comprise, for example, the same fluid (compressed air) used to generate the water jet for cutting, connecting the inlet 29 to a source of the pressurised fluid.

The invention claimed is:

1. An abrasive fluid jet cutting device, comprising:

a rotating assembly that includes at least one first path for solid particles and at least one second path for fluid, said rotating assembly comprising portions which rotate together around a rotation axis, said first path being defined at least in part between a first pipe and a second pipe internal to said first pipe and said second path being defined at least in part inside said second pipe;

a particles-fluid mixing zone where said first path and said second path flow into;

a first volume arranged along said first path to accumulate solid particles, said first volume being bounded at least in part by a first volume rotating portion of said rotating assembly;

a second volume arranged along said first path to accumulate solid particles between said first volume and said mixing zone, said second volume comprising a bottom at least in part arranged on a second volume lower rotating portion of said rotating assembly; and at least a third pipe between said first and second pines, said second volume being bounded at least in part by a portion to which said first pipe is fixed and by a further portion to which said third pipe is fixed.

2. The device according to claim 1, wherein said first volume and said second volume communicate respectively with an upper end of at least one portion of said first path and with a lower end of said at least one portion of said first path.

3. The device according to claim 1, wherein at least one first portion of said first path connects together said first volume and said second volume.

4. The device according to claim 3, wherein said first portion of said first path comprises a passage section with an area that is reduced by at least half, or at least by a third, or at least a quarter, or at least a fifth, or at least a sixth, with respect to a section of said first volume and/or with respect to a section of said second volume.

5. The device according to claim 1, wherein at least one second portion of said first path connects together said second volume and said mixing zone.

6. The device according to claim 5, wherein said second portion of said first path comprises a passage section with an area that is reduced by at least half, or at least by a third, or at least a quarter, or at least a fifth, or at least a sixth, with respect to a section of said first volume and/or with respect to a section of said second volume.

7. The device according claim 1, wherein said first path comprises at least one inlet for drying fluid.

8. The device according to claim 7, wherein said inlet for drying fluid flows into said second volume.

9. The device according to claim 7, wherein said rotating assembly includes said inlet for drying fluid.

10. The device according to claim 1, wherein at least one portion of said first path comprises a passage section of annular shape that surrounds at least one portion of said second path.

11. The device according to claim 1, wherein said rotating assembly extends along a vertical axis and rotates around said vertical axis, said first volume being further bounded at least in part by a static portion, said first volume rotating portion and said static portion being coupled rotatably with one another.

12. The device according to claim 11, comprising an inlet for solid particles arranged on said static portion.

13. The device according to claim 11, wherein said second volume lower rotating portion comprises a bottom of countersunk shape decreasing downwards, said bottom being tilted towards an outlet for particles arranged on a said rotating portion of said rotating assembly.

14. The device according to claim 1, comprising a cutting head that comprises said mixing zone, at least one inlet for particles that communicates with said mixing zone, at least one inlet for fluid that communicates with said mixing zone, and at least one outlet for a particle-fluid jet that communicates with said mixing zone, said inlet for particles of said cutting head being connected to an outlet for particles of said rotating assembly arranged downstream of said second volume.

15. The device according to claim 1, wherein:

said second volume is bounded at least in part by a second volume upper rotating portion to which said first pipe is fixed.

16. An abrasive fluid jet cutting device, comprising:

a rotating assembly that includes at least one first path for solid particles, and at least one second path for fluid, said first path being defined at least in part between a first pipe and a second pipe internal to said first pipe and said second path being defined at least in part inside said second pipe, said rotating assembly further including at least a third protecting pipe arranged between said first and second pipes;

a particles-fluid mixing zone where said first path and said second path flow into;

a first volume arranged along said first path to accumulate solid particles, at least one portion of said second pipe and/or at least one portion of said third pipe passing through said first volume; and a second volume arranged along said first path to accumulate solid particles between said first volume and said mixing zone, said, second volume comprising a bottom at least in part arranged on a second volume lower rotating portion of said rotating assembly, wherein:

said second volume is bounded at least in part by a first flanged portion to Which said first pipe is fixed;

said second volume is bounded at least in part by a second flanged portion to which said third pipe is fixed;

said first and second flanged portions are fixed together and said second flanged portion bounds said bottom of said second volume;

said first flanged portion comprises at least one hole for coupling with said first pipe and said second flanged portion comprises at least one hole for coupling with said third pipe; and said second flanged portion comprises at least one particles outlet and at least one fluid outlet that are spaced apart from one another.

* * * * *